United States Patent [19]

Nikawitz

[11] 3,981,814

[45] Sept. 21, 1976

[54] BACTERIOSTATIC SUBSTITUTED BENZANILIDE COMPOSITIONS AND METHODS FOR THEIR USE

[75] Inventor: Edward J. Nikawitz, Glen Rock, N.J.

[73] Assignee: Givaudan Corporation, Clifton, N.J.

[22] Filed: Apr. 21, 1975

[21] Appl. No.: 570,140

Related U.S. Application Data

[63] Continuation of Ser. No. 398,522, Sept. 18, 1973, abandoned.

[52] U.S. Cl. ..... 252/107; 252/106; 260/558 D; 260/558 P; 424/324

[51] Int. Cl.[2] ..... C11D 3/48; C11D 9/50

[58] Field of Search ..... 252/106, 107; 424/324; 260/558 P, 558 D

[56] References Cited

UNITED STATES PATENTS

| | | | |
|---|---|---|---|
| 2,965,575 | 12/1960 | Beaver et al. | 252/106 |
| 3,142,703 | 7/1964 | Stecker | 260/559 |
| 3,244,585 | 4/1966 | Stecker | 252/106 X |
| 3,256,200 | 6/1966 | Reller et al. | 252/106 |
| 3,281,466 | 10/1966 | Stecker | 260/559 |
| 3,331,874 | 7/1967 | Stecker | 260/562 |
| 3,407,056 | 10/1968 | Schwartz | 71/118 |
| 3,455,940 | 7/1969 | Stecker | 260/295 |
| 3,700,778 | 10/1972 | Hyndman | 424/324 |
| 3,706,796 | 12/1972 | Blake | 260/558 D |
| 3,814,806 | 6/1974 | Stoffel | 424/324 |

FOREIGN PATENTS OR APPLICATIONS

| | | |
|---|---|---|
| 101,258 | 3/1965 | Denmark |
| 2,246,308 | 3/1973 | Germany |

OTHER PUBLICATIONS

Chem. Absts., 8th Collective Index, pp. 4534s and 4535s. (1971).

*Primary Examiner*—P.E. Willis, Jr.
*Attorney, Agent, or Firm*—Thomas Cifelli, Jr.

[57] ABSTRACT

Substituted benzanilides useful as bacteriostatic agents, the benzanilides being characterized by the presence in the aniline moiety of at least one trifluoromethyl group and having the formula:

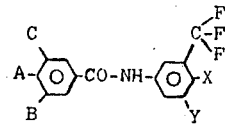

wherein:

A is selected from the group of H, Cl, Br, $CF_3$ and $C(CH_3)_3$;

B is selected from the group of H, Cl, and Br;

C is selected from the group of H, and Cl;

X is selected from the group of H, Cl, Br, and F; and

Y is selected from the group of H and $CF_3$;

except:

when X is Cl, C must be H;

when Y is $CF_3$, B must be H unless A is Cl such that B can then be either H or Cl; at least one of A, B, C or X having a halide substituent and the positions in the phenyl moieties ortho to the —CO— and —NH— are free of substituents.

41 Claims, No Drawings

BACTERIOSTATIC SUBSTITUTED BENZANILIDE COMPOSITIONS AND METHODS FOR THEIR USE

This is a continuation of application Ser. No. 398,522 filed Sept. 18, 1973, now abandoned.

BACKGROUND OF THE INVENTION

1. Field of the Invention

This invention relates to bacteriostatic compositions for inhibiting the growth of bacteria and, more particularly, to the utilization of substituted benzanilides which exhibit bacteriostatic activity, especially when incorporated in formulations containing soaps or other surface active agents.

2. The Prior Art

Many compounds have been suggested by the art as bacteriostatic agents in soaps, detergents and cosmetics. However, as is well known to those skilled in the art, many of these bacteriostatic compounds have some serious limitations in their use. For example, phenolic bacteriostats such as bisphenols, salicylanilides and hydroxydiphenyl ethers are photosensitive and when incorporated into a soap or detergent bar will discolor the bar upon prolonged exposure to sunlight. Bacteriostatic carbamates of bisphenols of the type disclosed in U.S. Pat. No. 3,651,128 although not photosensitive, exhibit poor solubility in alcohol solvents which reduces their utility in cosmetic and topical pharmaceutical preparations. Bacteriostatic carbanilides, which are also not photosensitive and do not effect the whiteness of soap, are, however, more toxic upon degradation than is desirable, thereby limiting their use in soaps and cosmetics.

SUMMARY OF THE INVENTION

In accordance with the present invention, there is provided a substituted benzanilide useful in bacteriostatic compositions and in a method for imparting bacteriostatic activity to soap, detergent and cosmetic formulations, the substituted benzanilide characterized by the presence in the aniline moiety of at least one trifluoromethyl group, and having the formula:

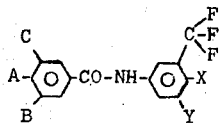

wherein:

A is selected from the group of H, Cl, Br, $CF_3$ and $C(CH_3)_3$;

B is selected from the group of H, Cl, and Br;

C is selected from the group of H, and Cl;

X is selected from the group of H, Cl, Br and F; and

Y is selected from the group of H and $CF_3$;

except:

when X is Cl, C must be H;

when Y is $CF_3$, B must be H unless A is Cl such that B can be either H or Cl;

at least one of A, B, C or X having a halide substituent and the positions in the phenyl moieties ortho to the —CO— and —NH— are free of substituents.

As will hereinafter be further illustrated, compounds having chemical structures closely related to the substituted benzanilides of the present invention are substantially devoid of any antimicrobial activity and have no utility as bacteriostatic agents.

The substituted benzanilides useful in the compositions and method of the present invention, exhibit in the presence of soap a minimum bacteriostatic activity of 2.50 mcg/ml against *Staph. aureus*, display little or no tendency to discolor under the influence of light and exhibit a low degree of oral toxicity. For example, 4-chloro-3′, 5′-di(trifluoromethyl)-benzanilide has an $LD_{50}$ of 6,000 ± 1833 mcg/kg, determined in rats.

Representative members of the pertinent anilides of the present invention, e.g. 4,4′-dibromo-α,α,α-tirfluoro-m-benzotoluidide, 4-chloro-3′, 5′-di(trifluoromethyl)-benzanilide and 4-bromo-α,α,α,α′,α′,α′,-hexafluoro-benzo-3′, 5′-xylidide are soluble or fairly soluble in alcohol solvents.

Methods used for the preparation of the substituted benzanilides of the present invention are known to and described by the art, as for example, Houben-Weyl, Methoden der Organischem Chemic, Stickstoffverbindugen, II/III, 4–14. In general, the substituted benzanilides of the present invention are prepared by the reaction of substantially equal molar amounts of a halogen or $CF_3$ substituted benzoyl chloride and trifluoromethyl substituted aniline in the presence of a suitable solvent and acid acceptor such as pyridine at a temperature of about 0° to 100°C. for time periods ranging from 1 to 30 hours.

The reaction products are precipitated from the reaction mixture by an excess of water. If the solvent used is pyridine or other alkaline solvent, it is desirable to partially or completely neutralize the solvent with an acid such as hydrochloric acid. Recrystallization of the filtered crude product may be achieved from suitable solvents as for example, toluene, toluene-hexane blends and dilute alcohols.

The substituted benzanilides obtained by recrystallization are crystalline, white, odorless solids which are soluble in acetone, alcohol or dimethylformamide.

The substituted benzanilides of the present invention may be used as anti-bacterial agents by themselves or along with a wide variety of capillary or surface-active materials besides soap. Such materials include salts of sulfated alcohols such as sodium sulfate, for example; salts of sulfated and sulfonated alkyl acids amides ("Igepon T"); salts of alkylaryl sulfonates, e.g. sodium dodecylbenzene sulfonate; alkylnaphthalenesulfonic acids and their salts ("Nekal"); salts of sulfonated alkylaryl polyether alcohols (Triton 720); and many other products, detergents and emulsifiers known to the art whether of the anionic, cationic, nonionic or amphoteric types of surface active agents. A more complete description of many of the materials included in the class of capillary active and surface active agents referred to above may be found in Encyclopedia of Surface-Active Agents, I.P. Sisley, Chemical Publishing Co.. Inc., New York, N.Y., and Surface Active Agents, A. M. Schwartz and I. W. Perry, Interscience Publishers, Inc., New York, N.Y.

As is well known, many of the available bacteriostatic agents, notably those of the quaternary ammonium salt type, are inactivated in the presence of capillary-active or surface active agents such as soaps and detergents. The bacteriostatic activity of the substituted benzanildes of the present invention, however, as a general rule, is not substantially reduced by a wide variety of surface-active substances, and in some cases is even improved. For this reason, the substituted benzanilides are especially useful in combination with such capillary-active materials.

As other examples of particular applications of the substituted benzanilides of this invention, their use with dry powdered carriers such as starch or talcum, with or without other medicants, is noted. Incorporation into pressed solids may also be effected, if desired. Solutions of the substituted benzanilides of this invention in suitable solvents may be incorporated into cosmetic compositions in stick, paste, jelly, cream, lotion, roll-on, spray aerosol or other forms. The compounds of this invention can also be finely milled and incorporated into ointments by conventional techniques to render the ointments antibacterial. In addition, solutions or dispersions of the substituted benzanilides may also be used for cleaning medical instruments, food processing equipment, or any other surface upon which it is desired to control bacteria.

Relatively small amounts of the substituted benzanilides may be used in the antibacterial compositions described above, including soaps and other surface-active or detergent compositions, which may be considered to be typical as to concentration levels. Amounts as low as 0.1% to 1%, based upon the total weight of the composition may be employed although a range of about 1 to 3% is usually preferred. Amounts less than about 0.1% are generally of little value since they generally do not produce a useful degree of activity. Although 5% or more may be used, the upper limit of the amount of agent which may be used is determined by practical considerations. As a general rule, increasing the concentration of agent in the composition increases the germicidal activity of the resulting product. However, the cost of the agent relative to the cost of the product itself mitigates against the use of too large an amount of the agent. Moreover, large amounts of the agent are to be avoided if such use would adversely affect the properties of the product.

With respect to soap, the invention may be practiced by adding the agents to the soap in any suitable manner during the crushing or milling or similar operation. Care should be taken to obtain a uniform distribution of the agent throughout the soap. They may be dissolved in a small amount of a suitable solvent or may be dispersed or wetted with a suitable dispersing or wetting agent before incorporation into soap. In general, any method which results in the agent being uniformly incorporated into the final soap product is satisfactory.

The bacteriostatic compounds, as noted above, can also be incorporated in similar concentrations in cosmetic formulations and detergent compositions other than soaps, according to known techniques fully familiar to those skilled in the art. The substituted benzanilides of the present invention are also suitable for use in aerosols applied to animate or inanimate surface or for air disinfection.

A similar range of total concentration of bacteriostats can also be employed for mixtures of the substituted benzanilides with other bacteriostats, as for instance, bacteriostatic phenols, bisphenols, carbanilides, salicylanilides or any other bacteriostat or bactericide.

The following examples will further illustrate the invention.

EXAMPLE I

Preparation of 4-Chloro-3′-(trifluoromethyl) benzanilide

Fifty grams (g.) m-aminobenzotrifluoride and 150 milliliters (ml) pyridine were charged into a 500 ml flask equipped with a sealed stirrer, reflux condenser, thermometer and dropping funnel. To the flask was added with agitation, over a period of 1 hour, 54.7 g. p-chlorobenzoyl chloride. The contents of the flask were maintained at 10°C. during the addition of the p-chlorobenzoyl chloride. A precipitate formed and 50 ml pyridine was added to facilitate agitation. Agitation was continued for 20 hours at room temperature followed by heating for 2 hours at 55°C. whereupon the contents of the flask were poured into 3 liters of ice water and allowed to stand for about 3 hours. The ice-water solution was filtered and the dried solid product yield was 84.9 g. Recrystallization of the product in 100 ml ethanol for 12 hours at −10°C. yielded 63.4 g of a white solid having a melting point of 113°–115°C. and a chlorine, nitrogen analysis as follows:

| | Calculated for $C_{14}H_9Cl\ F_3NO$ | Found |
|---|---|---|
| % Cl | 11.83 | 11.85 |
| % N | 4.67 | 4.95 |

EXAMPLE II

Preparation of 4′-Chloro-α,α,α,α′,α′,α′, -hexafluoro-p-tolu-m-toluidide

To 4.5 g. 5-amino-2-chlorobenzotrifluoride and 50 ml. pyridine contained in a 250 ml. reaction flask equipped with sealed stirrer, reflux condenser, thermometer and dropping funnel was added 4.7 g. p-(trifluoromethyl) benzoyl chloride in 5 ml. dioxane over a 30 minute period. The contents of the flask were agitated during the addition of the p-(trifluoromethyl) benzoyl chloride and agitation was continued for 1 hour at 23°C. and an additional 4 hours at 80°C. The contents of the flask were then poured into 1 liter of ice water to which was added 100 ml. concentrated HCl and allowed to stand for 24 hours. Filtration yielded 8.1 g. of a crude product which upon recrystallization in 70 ml. toluene yielded 5.3 g. of a white solid having a melting point of 163° – 165°C. and a fluorine analysis as follows:

| | Calculated for $C_{15}H_8Cl\ F_6NO$ | Found |
|---|---|---|
| % F | 31.0 | 31.1 |

EXAMPLE III

Preparation of 4,4′-Dichloro-3′(trifluoromethyl) benzanilide

The procedure of Example II was repeated with the exception that the following reactants and reaction conditions were used:

Reactants:

2.6 g. 5-amino-2-chlorobenzotrifluoride in 40 ml. pyridine 2.3 g. p-chlorobenzoyl chloride in 5 ml. dioxane Reaction conditions:

20 hr. agitation at 23°C. followed by 6 hour agitation at 80°C.

Recrystallization of the crude product in 40 ml of 85% alcohol yielded 2.2 g. of a white solid having a melting point of 137° – 138.5°C. and a carbon, hydrogen and fluorine analysis as follows:

| | Calculated for $C_{14}H_8Cl_2F_3NO$ | Found |
|---|---|---|
| % C | 50.3 | 50.43 |
| % H | 2.42 | 2.45 |
| % F | 17.05 | 17.29 |

EXAMPLE IV

Preparation of 3,4′-dichloro-α,α,α-trifluoro-m-benzo-toluidide.

The procedure of Example II was repeated with the exception that the reactants were 7.8 g. 5-amino-2-chlorobenzotrifluoride in 100 ml pyridine and 6.9 g. m-chlorobenzoyl chloride in 10 ml dioxane.

The crude product was recovered by pouring the reaction product in 1500 ml ice water followed by 200 ml concentrated HCl. Recrystallization of the crude product from an 80 ml/70 ml hexane/toluene blend yielded 9.8 g. of a white solid having a melting point of 135° – 137°C. and a carbon, hydrogen, fluorine analysis as follows:

| | Calculated for $C_{14}H_8Cl_2F_3NO$ | Found |
|---|---|---|
| % C | 50.3 | 50.24 |
| % H | 2.42 | 2.46 |
| % F | 17.05 | 16.78 |

EXAMPLE V

Preparation of 4-bromo-4′-chloro-α,α,α-trifluoro-m-benzotoluidide

The procedure of Example II was repeated with the exception that the following reactants and reaction conditions were used:

Reactants:

7.8 g. 5-amino-2-chlorobenzotrifluoride in 70 ml. pyridine.

8.8 g. 4-bromobenzoyl chloride

Reaction conditions:

3 hour agitation at 23°C. followed by 4 hour agitation at 80°C.

The reaction product was poured into 2 l. ice water and 100 ml. concentrated HCl and 16.7 g. of a crude product was recovered by filtration.

The crude product was washed by agitation for one hour in 60 ml. 10% NaOH diluted with 60 ml. $H_2O$. The washing was repeated with 60 ml. 10% HCl diluted with 60 ml. $H_2O$.

Recrystallization of the washed crude product from a 90 ml/100 ml. toluene/hexane blend followed by a water (15 ml)-ethanol (60 ml) mixture yielded 3.8 g. of a white solid having a melting point of 136°–137.5°C. and a carbon, hydrogen, fluorine analysis as follows:

| | Calculated for $C_{14}H_8BrClF_3NO$ | Found |
|---|---|---|
| % C | 44.4 | 44.52 |
| % H | 2.13 | 2.27 |
| % F | 15.09 | 15.38 |

EXAMPLE VI

Preparation of 4,4′-dibromo-α,α,α-trifluoro-m-benzotoluidide

The procedure of Example II was repeated with the exception that the following reactants and reaction conditions were used:

Reactants:

2.4 g. 5-amino-2-bromobenzotrifluoride in 50 ml. pyridine 2.2 g. 4-bromobenzoyl chloride Reaction conditions:

20 hour agitation at 23°C. followed by 2 hour agitation at 80°C.

The reaction product was poured in 1 l. ice water and 100 ml. concentrated HCl and 4 g. of a crude product was recovered by filtration.

Recrystallization of the crude product in a blend of 30 ml. of hexane and 35 ml. of toluene yielded 3.5 g. of a white solid having a melting point of 147° – 149.5°C. and a fluorine analysis as follows:

| | Calculated for $C_{14}H_8Br_2F_3NO$ | Found |
|---|---|---|
| % F | 13.48 | 13.6 |

EXAMPLE VII

Preparation of 4′-bromo-3,4-dichloro-α,α,α-trifluoro-m-benzotoluidide

The procedure of Example VI was repeated with the exception that 2.4 g. 5-amino-2-bromo-benzotrifluoride in 50 ml. pyridine and 2.1 g. 3,4-dichlorobenzoyl chloride were used as the reactants.

Recrystallization of 3.8 g. of the crude product from a 30 ml. hexane/55 ml. toluene blend yielded 3.3 g. of a white solid having a melting point of 188° – 191°C. and a carbon, hydrogen and fluoride analysis as follows:

| | Calculated for $C_{14}H_7BrCl_2F_3NO$ | Found |
|---|---|---|
| % C | 40.6 | 40.4 |
| % H | 1.71 | 1.63 |
| % F | 13.8 | 14.1 |

EXAMPLE VIII

Preparation of 3,4′-dibromo-α,α,α-trifluoro-m-benzotoluidide

The procedure of Example II was repeated with the exception that the following reactants and reaction conditions were used:

Reactants:

2.4 g. 5-amino-2-brombenzotrifluoride in 50 ml. pyridine.

2.2 g. 3-bromobenzoyl chloride

Reaction conditions:

1 hour agitation at 23°C. followed by 4 hour agitation at 80°C.

The reaction product was poured into 1.5 l. of ice water containing 100 ml. concentrated HCl and 4.6 g. of a crude product was recovered by filtration.

Recrystallization of the crude product from a 40 ml. hexane/35 ml. toluene blend and then from a 40 ml. hexane/30 ml. toluene blend yielded 2.7 g. of a white solid having a melting point of 142° – 144°C. and a fluorine analysis as follows:

| | Calculated for $C_{14}H_8Br_2F_3NO$ | Found |
|---|---|---|
| % F | 13.48 | 13.3 |

EXAMPLE IX

Preparation of 4'-bromo-4-chloro-α,α,α-trifluoro-m-benzotoluidide

The procedure of Example VIII was repeated with the exception that 3.6 g. 5-amino-2-bromobenzotrifluoride in 50 ml. pyridine and 2.6 g. 4-chlorobenzoyl chloride were used as the reactants.

Recrystallization of 5.6 g. of the crude product from a 40 ml. hexane/55 ml. toluene blend yielded 4.2 g. of a white solid having a melting point of 153° – 154°C. and a carbon, hydrogen and fluorine analysis as follows:

| | Calculated for $C_{14}H_8BrCl\ F_3NO$ | Found |
|---|---|---|
| % C | 44.4 | 44.43 |
| % H | 2.54 | 2.24 |
| % F | 15.09 | 15.37 |

EXAMPLE X

Preparation of 4-chloro-α,α,α, 4'-tetrafluoro-m-benzotoluidide

The procedure of Example VIII was repeated with the exception that 3.6 g. 5-amino-2-fluorobenzotrifluoride in 50 ml. pyridine and 3.5 g. 4-chlorobenzoyl chloride were used as the reactants.

Recrystallization of 6.3 g. of the crude product from a 50 ml. toluene/25 ml. hexane blend yielded 5.2 g. of a white solid having a melting point of 141° – 142°C. and a fluorine analysis as follows:

| | Calculated for $C_{14}H_8Cl\ F_4NO$ | Found |
|---|---|---|
| % F | 24.95 | 25.1 |

EXAMPLE XI

Preparation of 4-bromo-α,α,α, 4'-tetrafluoro-m-benzotoluidide

The procedure of Example VIII was repeated with the exception that 3.6 g. 5-amino-2-fluorobenzotrifluoride in 50 ml. pyridine and 4.4 g. p-bromobenzoyl chloride were used as the reactants.

Recrystallization of 7 g. of the crude product from a 10 ml. hexane/50 ml. toluene blend yielded 5.2 g. of a white solid having a melting point of 135° – 137°C. and a fluorine analysis as follows:

| | Calculated for $C_{14}H_8Br\ F_4NO$ | Found |
|---|---|---|
| % F | 21.0 | 21.3 |

EXAMPLE XII

Preparation of 4-chloro-3',5'-di(trifluoromethyl)-benzanilide

The procedure of Example II was repeated with the exception that the following reactants and reaction conditions were used:

Reactants:

9.2 g. 3,5-di(trifluoromethyl) aniline in 70 ml. pyridine 7 g p-chlorobenzoyl chloride Reaction conditions:

Agitation at 23°C. for 20 hours followed by 7 hour agitation at 80°C.

The reaction product was poured in 1 l. of water and 11.3 g. of a crude product was recovered by filtration.

Recrystallization of the crude product from a 60 ml. hexane/65 ml. toluene blend yielded 9.7 g. of a white solid, having a m.p. of 168° – 170.5°C. and a carbon, hydrogen and fluorine analysis as follows:

| | Calculated for $C_{15}H_8Cl\ F_6NO$ | Found |
|---|---|---|
| % C | 49.0 | 48.95 |
| % H | 2.2 | 2.35 |
| % F | 31.1 | 31.13 |

EXAMPLE XIII

Preparation of 4-bromo-α,α,α,α',α',α'-hexafluorobenzo-3',5'-xylidide

The procedure of Example II was repeated with the exception that the following reactants and reaction conditions were used:

Reactants:

6.9 g. 3,5-di(trifluoromethyl)aniline in 60 ml. pyridine and 6.6 g. 4-bromobenzoyl chloride in 5 ml. dioxane.

Reaction conditions:

Agitation at 23°C. for 2 hours followed by agitation for 5½ hours at 70°C.

The reaction product was poured in 2 l. ice water containing 100 ml. concentrated HCl, and the crude product was recovered by filtration. The crude product was washed by agitation for 1 hour in 30 ml. 10% HCl diluted with 100 ml. $H_2O$. The washing was repeated with 30 ml. 10% NaoH diluted with 100 ml. $H_2O$.

Recrystallization of the washed crude product (11.1 g.) from a 40 ml. hexane/55 ml. toluene blend yielded 9.1 g. of a white solid having a melting point of 168.5° – 170°C. and a carbon, hydrogen and fluorine analysis as follows:

| | Calculated for $C_{15}H_8Br\ F_6NO$ | Found |
|---|---|---|
| % C | 43.7 | 43.91 |
| % H | 1.96 | 1.96 |
| % F | 27.70 | 27.8 |

EXAMPLE XIV

Preparation of 3,4-dichloro-α,α,α,α′,α′,α′-hexafluorobenzo-3′,5′-xylidide

The procedure of Example XIII was repeated with the exception that 4.6 g. 3,5-di(trifluoromethyl) aniline in 50 ml. pyridine and 4.2 g. 3,5-dichlorobenzoyl chloride in 5 ml. dioxane were used as the reactants.

Recrystallization of 7.3 g. of the crude product from 85 ml. toluene yielded 4.3 g. of a white solid having a melting point of 204° – 210°C.

The recrystallized product was washed in the same manner as the crude product of Example XIII and 3.9 g. of a white solid having a melting point of 214° – 216.5°C. was obtained having a carbon, hydrogen and fluorine analysis as follows:

| | Calculated for $C_{15}H_7Cl_2F_6\ NO$ | Found |
|---|---|---|
| % C | 44.8 | 44.7 |
| % H | 1.75 | 1.97 |
| % F | 28.40 | 28.62 |

EXAMPLE XV

The antibacterial properties of the compounds prepared in Examples 1 – 14 were tested in soap. The in vitro soap bacteriostatic tests were conducted as follows: The compound is dissolved in a suitable solvent, usually dimethylformamide, to give a 6% solution. One-half ml. aliquot was added to 100 ml. of 3% solution of bar soap stock solution. The solid soap used was a neutral white toilet soap of the "LUX" type. The fatty acids in this soap were of the following composition:

| | Percent |
|---|---|
| Oleic and Linoleic acids | About 45 |
| Palmitic acid | About 10 |
| Lower fatty acids (lauric, etc.) | About 15 |
| Stearic acid | About 30 |

This yields an aqueous soap solution containing 30,000 mcg./ml. soap and 300 mcg./ml. compound. The soap/compound ratio in the latter is 100/l. A two-fold serial dilution series is prepared with this solution using sterile distilled water in test tubes such that the final volume in each tube is 2.0 ml. To each test tube is added 28 ml. of molten Dextrose Trypticase Extract Agar (B.B.L.). The tube contents were poured into sterile Petri plates and allowed to harden. The highest final concentration of compound in the serial dilution series is 20 mcg./ml. Plates were spot inoculated with a broth culture of Staphylococcus aureus and incubated at 35° for 48 hours. The lowest concentration completely inhibiting growth of the test organism, in mcg./ml. is recorded as the bacteriostatic concentration of the compound. Tests in the absence of soap are made in a similar manner except that all dilutions are made in solvent. The final concentration in the agar should not be greater than 5%.

The results of these tests with the compounds of the present invention as compared with compounds having chemical structures closely related to the compounds of the present invention (designated by the symbol "C") are set forth in the Table. Column 1 contains the data as to the activity of the test solution without soap; column 2 refers to tests in which the ratio of soap to compound is 100:1. In both cases the numbers mean minimum concentration (mcg./ml.) where S. aureus growth is completely inhibited. Growth is observed at the next lower concentration.

TABLE

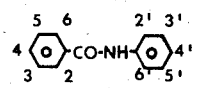

BENZANILIDE

| Compound No. | Radical Substituted in Benzanilide Position Number | | | | | | | | Compound Activity Without Soap | Compound Activity With Soap |
|---|---|---|---|---|---|---|---|---|---|---|
| | 2 | 3 | 4 | 5 | 2′ | 3′ | 4′ | 5′ | | |
| 1 | | | Cl | | | $CF_3$ | | | 10 | 0.625 |
| 2 | | Cl | | | | $CF_3$ | | | A | 2.5 |
| 3 | | | Br | | | $CF_3$ | | | A | 2.5 |
| 4 | | Br | | | | $CF_3$ | | | A | 2.5 |
| 5 | | Cl | Cl | | | $CF_3$ | | | A | 2.5 |
| 6 | | Cl | | Cl | | $CF_3$ | | | A | 2.5 |
| 7 | | | $CF_3$ | | | $CF_3$ | Cl | | 0.625 | 0.312 |
| 8 | | | Cl | | | $CF_3$ | Cl | | 2.50 | 0.625 |
| 9 | | Cl | | | | $CF_3$ | Cl | | A | 0.625 |
| 10 | | | Br | | | $CF_3$ | Cl | | 0.625 | 0.312 |
| 11 | | Br | | | | $CF_3$ | Cl | | A | 2.5 |
| 12 | | Cl | Cl | | | $CF_3$ | Cl | | A | 0.312 |
| 13 | | | Br | | | $CF_3$ | Br | | 1.25 | 0.312 |
| 14 | | Br | | | | $CF_3$ | Br | | A | 1.25 |
| 15 | | | Cl | | | $CF_3$ | Br | | 0.625 | 0.625 |
| 16 | | Cl | Cl | | | $CF_3$ | Br | | A | 0.312 |
| 17 | | | Cl | | | $CF_3$ | F | | A | 1.25 |
| 18 | | | Br | | | $CF_3$ | F | | A | 1.25 |
| 19 | | | Cl | | | $CF_3$ | | $CF_3$ | 0.625 | 0.312 |
| 20 | | | Br | | | $CF_3$ | | $CF_3$ | 0.312 | 0.312 |
| 21 | | Cl | Cl | | | $CF_3$ | | $CF_3$ | A | 0.312 |

TABLE-continued

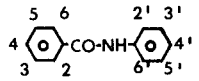

BENZANILIDE

| Compound No. | Radical Substituted in Benzanilide Position Number | | | | | | | | Compound Activity Without Soap | With Soap |
|---|---|---|---|---|---|---|---|---|---|---|
| | 2 | 3 | 4 | 5 | 2' | 3' | 4' | 5' | | |
| 22 | | | $C(CH_3)_3$ | | | $CF_3$ | Cl | | A | 2.5 |
| $C_1$ | Cl | | | | | $CF_3$ | | | A* | 10.0 |
| $C_2$ | Br | | | | | $CF_3$ | | | B** | B |
| $C_3$ | | | F | | | $CF_3$ | | | A | 10.0 |
| $C_4$ | | $CF_3$ | | | | $CF_3$ | | | A | 10.0 |
| $C_5$ | | | | | | $CF_3$ | | | A | 10.0 |
| $C_6$ | | Cl | | | $CF_3$ | | | | B | B |
| $C_7$ | | Cl | | | $CF_3$ | | | | B | B |
| $C_8$ | Cl | | | | $CF_3$ | | | | B | B |
| $C_9$ | | | Cl | | | | $CF_3$ | | B | B |
| $C_{10}$ | | | F | | | | $CF_3$ | | 20.0 | 5.0 |
| $C_{11}$ | | Cl | | Cl | | $CF_3$ | Cl | | B | B |
| $C_{12}$ | Cl | | | | | $CF_3$ | Cl | | A | 10.0 |
| $C_{13}$ | | | F | | | $CF_3$ | Cl | | A | 5.0 |
| $C_{14}$ | Br | | | | | $CF_3$ | Cl | | B | B |
| $C_{15}$ | | | Cl | | Cl | | | $CF_3$ | B | B |
| $C_{16}$ | | Cl | | | Cl | | | $CF_3$ | B | B |
| $C_{17}$ | Cl | | | | Cl | | | $CF_3$ | B | B |
| $C_{18}$ | | | F | | Cl | | | $CF_3$ | B | B |
| $C_{19}$ | | Br | | | Cl | | | $CF_3$ | B | B |
| $C_{20}$ | | | Cl | | $CF_3$ | | Cl | | B | B |
| $C_{21}$ | | Cl | | | $CF_3$ | | Cl | | B | B |
| $C_{22}$ | Cl | | | | $CF_3$ | | Cl | | B | B |
| $C_{23}$ | | | Cl | | | $CF_3$ | SCN | | A | 5.0 |
| $C_{24}$ | | Cl | Cl | | | $CF_3$ | SCN | | B | B |
| $C_{25}$ | | Cl | | | | $CF_3$ | | $CF_3$ | A | 10.0 |
| $C_{26}$ | Cl | | | | | $CF_3$ | | $CF_3$ | A | 10.0 |
| $C_{27}$ | | | F | | | $CF_3$ | | $CF_3$ | A | 10.0 |
| $C_{28}$ | | $CF_3$ | | | | $CF_3$ | | $CF_3$ | B | B |
| $C_{29}$ | | Br | | | | $CF_3$ | | $CF_3$ | B | B |
| $C_{30}$ | | | Cl | | | Cl | | | A | 5.0 |
| $C_{31}$ | | | Cl | | | Cl | Cl | | A | 10.0 |
| $C_{32}$ | | | Cl | | | Cl | | Cl | A | 10.0 |
| $C_{33}$ | | Cl | Cl | | | | Cl | | B | B |
| $C_{34}$ | | Cl | Cl | | | Cl | | | A | A |
| $C_{35}$ | | Cl | Cl | | | Cl | Cl | | B | B |
| $C_{36}$ | | Cl | Cl | | | Cl | | Cl | B | B |
| $C_{37}$ | | | Br | | | Cl | Cl | | 10.0 | 20.0 |
| $C_{38}$ | | | $CF_3$ | | | Cl | Cl | | A | 10.0 |
| $C_{39}$ | | | $C(CH_3)_3$ | | | $CF_3$ | | | A | 5.0 |

*A = Inactive at 20 mcg./ml. (highest concentration tested).
**B = Inactive at 10 mcg./ml. (highest concentration tested).

By reference to the Table it is immediately apparent that the anti-microbial activity of the compound is strictly dependent upon the position of the substituents and compounds closely related to the compounds of the present invention but which are not substituted in the same manner as the compounds of the present invention, when tested in a similar manner, are found to be inactive.

EXAMPLE XVI

The following is illustrative of typical soap formulations which can be prepared using the substituted benzanilides of the present invention:

a. Two parts of finely ground substituted benzanilide of the present invention are blended well with 98 parts of soda soap filings. The blend is then milled thoroughly and pressed into molds. The soda soap may be of the LUX type described above or any other suitable bar soap stock.

b. One part of any one of the finely ground bacteriostatic substituted benzanilide compounds of this invention is carefully blended with one part of 3,4,4'-trichlorocarbanilide or with one part of hexachlorophene or with one part of dibromosalicylanilide, or one part of tribromosalicylanilide, or one part of a mixture of the latter two (Diaphene). This mixture is intimately milled with 98 parts of soda soap filings as above and pressed into molds.

The mixture of the bacteriostats can also be first blended with one to two parts of sodium lauryl sulfate, or "Igepon T", or "Triton 720", and the resulting mixture is then intimately milled with 97–96 parts of soda soap.

The dispersing or wetting agents are, in another modification of procedure, first dissolved or emulsified in a small amount of water, acetone, alcohol, etc. and then blended with the bacteriostats of this invention or their combinations with other bacteriostats, prior to incorporation into soap.

c. An amount of 0.1 – 0.3 g. of any one of the effective substituted benzanilides of the present invention is dissolved in a blend of 95 g. ethanol and 5 g. of propylene glycol. This solution, filled in an aerosol container of suitable size, using nitrogen as propellent, is used as an effective bacteriostatic aerosol for air disinfection, disinfection of ananimate substances such as bath tubs or as deodorizing agent for the axilla and in intimate feminine hygiene.

What is claimed is:

1. A bacteriostatic detergent composition comprising a soap or detergent of the anionic, cationic, nonionic or amphoteric type and a bacteriostatically effective amount of a benzanilide having the formula:

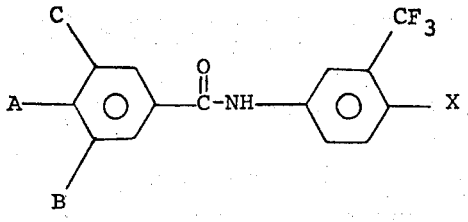

wherein:

A is selected from the group of H, Cl, Br, $CF_3$ and $C(CH_3)_3$;

B is selected from the group of H, Cl and Br;

C is selected from the group of H and Cl; and

X is selected from the group of H, Cl, Br and F;

except:

when X is Cl, C must be H; and wherein:

at least one of the groups A, B, C or X must be Cl or Br and the positions in the phenyl moieties ortho to the —CO— and —NH— are free of substituents.

2. The composition of claim 1 wherein the benzanilide is incorporated therein at a concentration ranging from about 0.1% to about 3% by weight based on the weight of the composition.

3. The composition of claim 1 wherein the benzanilide incorporated therein has the formula:

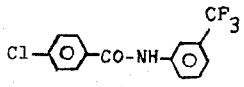

4. The composition of claim 1 wherein the benzanilide incorporated therein has the formula:

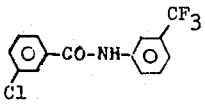

5. The composition of claim 1 wherein the benzanilide incorporated therein has the formula:

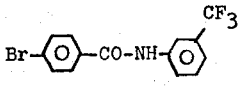

6. The composition of claim 1 wherein the benzanilide incorporated therein has the formula:

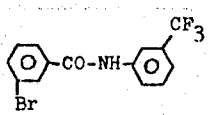

7. The composition of claim 1 wherein the benzanilide incorporated therein has the formula:

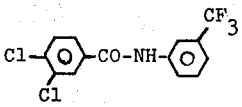

8. The composition of claim 1 wherein the benzanilide incorporated therein has the formula:

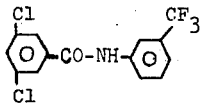

9. The composition of claim 1 wherein the benzanilide incorporated therein has the formula:

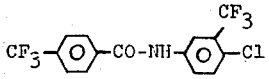

10. The composition of claim 1 wherein the benzanilide incorporated therein has the formula:

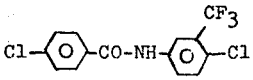

11. The composition of claim 1 wherein the benzanilide incorporated therein has the formula:

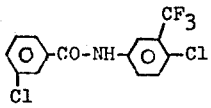

12. The composition of claim 1 wherein the benzanilide incorporated therein has the formula:

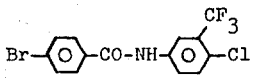

13. The composition of claim 1 wherein the benzanilide incorporated therein has the formula:

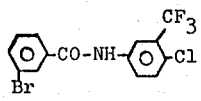

14. The composition of claim 1 wherein the benzanilide incorporated therein has the formula:

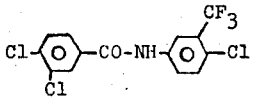

15. The composition of claim 1 wherein the benzanilide incorporated therein has the formula:

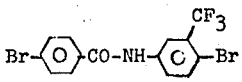

16. The composition of claim 1 wherein the benzanilide incorporated therein has the formula:

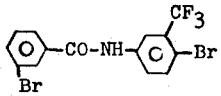

17. The composition of claim 1 wherein the benzanilide incorporated therein has the formula:

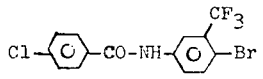

18. The composition of claim 1 wherein the benzanilide incorporated therein has the formula:

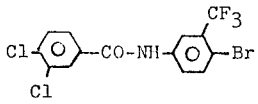

19. The composition of claim 1 wherein the benzanilide incorporated therein has the formula:

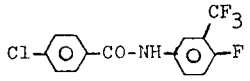

20. The composition of claim 1 wherein the benzanilide incorporated therein has the formula:

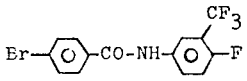

21. The composition of claim 1 wherein the benzanilide incorporated therein has the formula:

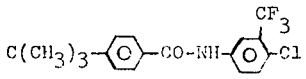

22. A method for imparting bacteriostatic activity in a detergent composition including a soap or a detergent of the anionic, cationic, nonionic or amphoteric type which comprises incorporating in the formulation a small, effective amount of a substituted benzanilide having the formula:

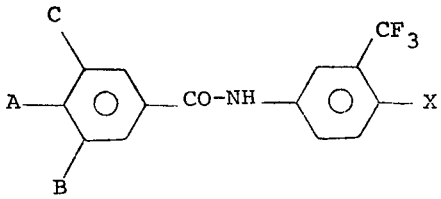

wherein:

A is selected from the group of H, Cl, Br, $CF_3$ and $C(CH_3)_3$;

B is selected from the group of H, Cl and Br;

C is selected from the group of H and Cl; and

X is selected from the group of H, Cl, Br and F;

except:

when X is Cl, C must be H; and wherein:

at least one of the groups A, B, C or X must be Cl or Br and the positions in the phenyl moieties ortho to the —CO— and —NH— are free of substituents.

23. The method of claim 22 wherein the benzanilide is incorporated in the formulation at a concentration of from about 0.1 to about 3% by weight based on the weight of the formulation.

24. The method of claim 22 wherein the benzanilide has the formula:

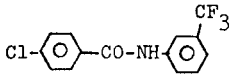

25. The method of claim 22 wherein the benzanilide has the formula:

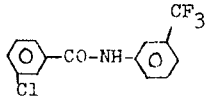

26. The method of claim 22 wherein the benzanilide has the formula:

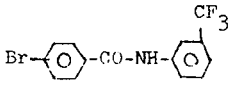

27. The method of claim 22 wherein the benzanilide has the formula:

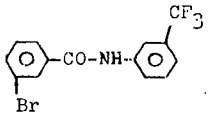

28. The method of claim 22 wherein the benzanilide has the formula:

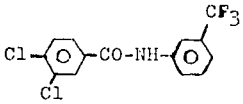

29. The method of claim 22 wherein the benzanilide has the formula:

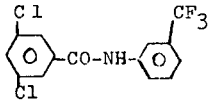

30. The method of claim 22 wherein the benzanilide has the formula:

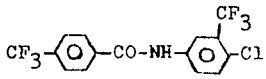

31. The method of claim 22 wherein the benzanilide has the formula:

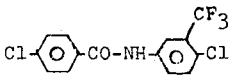

32. The method of claim 22 wherein the benzanilide has the formula:

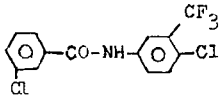

33. The method of claim 22 wherein the benzanilide has the formula:

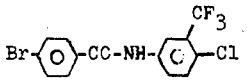

34. The method of claim 22 wherein the benzanilide has the formula:

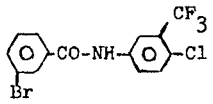

35. The method of claim 22 wherein the benzanilide has the formula:

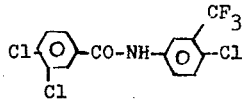

36. The method of claim 22 wherein the benzanilide has the formula:

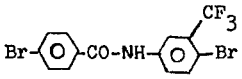

37. The method of claim 22 wherein the benzanilide has the formula:

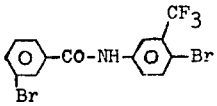

38. The method of claim 22 wherein the benzanilide has the formula:

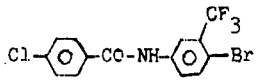

39. The method of claim 22 wherein the benzanilide has the formula:

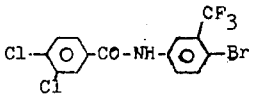

40. The method of claim 22 wherein the benzanilide has the formula:

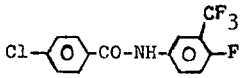

41. The method of claim 22 wherein the benzanilide has the formula:

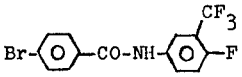

* * * * *

UNITED STATES PATENT OFFICE

CERTIFICATE OF CORRECTION

Patent No. 3,981,814 Dated September 21, 1976

Inventor(s) Edward J. Nikawitz

It is certified that error appears in the above-identified patent and that said Letters Patent are hereby corrected as shown below:

Column 2, line 12, "tir" should read -- tri --.

Column 2, line 13, ", 4-chloro" should read -- , 4-chloro--.

Column 2, line 14, "3, 5'" should read -- 3',5' --.

Column 2, line 15, "benzanilide and 4" should read -- benzanilide and 4 --.

Column 2, line 65, "zanildes" should read -- zanilides --.

Column 6, line 51, "fluoride" should read -- fluorine --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*